US008554093B2

(12) United States Patent
Fujita

(10) Patent No.: US 8,554,093 B2
(45) Date of Patent: Oct. 8, 2013

(54) IMAGE FORMING APPARATUS THAT ADOPTS IMAGE DENSITY CONTROL WITH DENSITY SENSORS

(75) Inventor: Sadao Fujita, Tokyo (JP)

(73) Assignee: Canon Kabushiki Kaisha (JP)

( * ) Notice: Subject to any disclaimer, the term of this patent is extended or adjusted under 35 U.S.C. 154(b) by 344 days.

(21) Appl. No.: 13/016,634

(22) Filed: Jan. 28, 2011

(65) Prior Publication Data

US 2011/0188871 A1 Aug. 4, 2011

(30) Foreign Application Priority Data

Jan. 29, 2010 (JP) ..... 2010-018850

(51) Int. Cl.
*G03G 15/00* (2006.01)

(52) U.S. Cl.
USPC ..... 399/49

(58) Field of Classification Search
USPC ..... 399/49, 72
See application file for complete search history.

(56) References Cited

U.S. PATENT DOCUMENTS 6,061,533 A * 5/2000 Kajiwara ..... 399/49

FOREIGN PATENT DOCUMENTS

JP 2004-117807 A 4/2004

* cited by examiner

*Primary Examiner* — William J Royer
(74) *Attorney, Agent, or Firm* — Rossi, Kimms & McDowell LLP

(57) ABSTRACT

An image forming apparatus that can reduce the time period for rotation of an intermediate transfer unit required before toner patches are formed, and measurement of toner patch densities while continuing the rotation. A toner image formed on a photosensitive drum is transferred to a surface of the intermediate transfer unit. A toner image for detection is formed on the intermediate transfer unit, and image forming conditions are corrected based on the amount of toner obtained by reading the toner image for detection. Two density sensors read the surface of the intermediate transfer unit. Outputs from the two density sensors are stored as a first profile and a second profile, respectively. A toner density of the toner image for detection is calculated based on the first and second profiles, and image forming conditions are corrected based on the toner density.

6 Claims, 15 Drawing Sheets

BASE PROFILE

| SAMPLING NO. | SENSOR OUTPUT |
|---|---|
| 0 | 3.52 |
| 1 | 3.46 |
| 2 | 3.41 |
| 3 | 3.47 |
| 4 | 3.51 |
| ... | ... |
| 120 | 3.48 |
| 121 | 3.49 |
| 122 | 3.41 |
| 123 | 3.44 |
| ... | ... |
| 140 | 3.45 |
| 141 | 3.49 |
| 142 | 3.47 |
| ... | ... |
| 2000 | 3.64 |

TONER PATCH PROFILE

| SAMPLING NO. | SENSOR OUTPUT |
|---|---|
| 0 | 3.52 |
| 1 | 3.46 |
| 2 | 3.41 |
| 3 | 3.47 |
| 4 | 3.51 |
| ... | ... |
| 120 | 3.48 |
| 121 | 1.53 |
| 122 | 1.57 |
| 123 | 1.56 |
| ... | ... |
| 140 | 1.61 |
| 141 | 1.58 |
| 142 | 3.47 |
| ... | ... |
| 2000 | 3.64 |

BASE PROFILE

| SAMPLING NO. | SENSOR OUTPUT |
|---|---|
| 0 | 3.52 |
| 1 | 3.46 |
| 2 | 3.41 |
| 3 | 3.47 |
| 4 | 3.51 |
| ... | ... |
| 120 | 3.48 |
| 121 | 3.49 |
| 122 | 3.41 |
| 123 | 3.44 |
| ... | ... |
| 140 | 3.45 |
| 141 | 3.49 |
| 142 | 3.47 |
| ... | ... |
| 2000 | 3.64 |

TONER PATCH PROFILE

| SAMPLING NO. | SENSOR OUTPUT |
|---|---|
| 0 | 3.52 |
| 1 | 3.46 |
| 2 | 3.41 |
| 3 | 3.47 |
| 4 | 3.51 |
| ... | ... |
| 120 | 3.48 |
| 121 | 1.53 |
| 122 | 1.57 |
| 123 | 1.56 |
| ... | ... |
| 140 | 1.61 |
| 141 | 1.58 |
| 142 | 3.47 |
| ... | ... |
| 2000 | 3.64 |

——— SENSOR OUTPUT PROFILE OBTAINED FROM BASE OVER ONE CIRCUMFERENCE THEREOF

-------- SENSOR OUTPUT PROFILE OBTAINED WITH TONER PATCH PUT ON BACE

IMAGE FORMING APPARATUS THAT ADOPTS IMAGE DENSITY CONTROL WITH DENSITY SENSORS

BACKGROUND OF THE INVENTION

1. Field of the Invention

The present invention relates to an image forming apparatus such as a copier or a printer using an electrophotographic method, and a control method for the image forming apparatus, and in particular to an image forming apparatus that adopts image density control using density sensors.

2. Description of the Related Art

Conventionally, image forming apparatuses such as copiers and printers using an electrophotographic method have adopted image density control using a density sensor so as to maintain image densities of continuously output prints uniform. Examples of the density sensor include an optical sensor comprised of a light-emitting unit consisting of an infrared light-emitting device such as an LED, and a light-receiving unit consisting of a photodiode.

In an example of the image density control, unfixed toner patches formed on an intermediate transfer unit with predetermined timing are read by the density sensor located in the vicinity of the intermediate transfer unit. Then, toner patch densities equivalent to amounts of toner are measured from detected values (output values) from the density sensor, and print data is corrected based on the toner patch densities. In another example of the image density control, a development contrast is corrected based on toner patch densities obtained by the density sensor. In the case of the image density control in which the development contrast is corrected, a dark potential VD on a photosensitive drum and a direct-current voltage VDC applied to a development sleeve are corrected, or laser power is corrected.

Thus, in the image density control, various image forming conditions are usually given feedback based on toner patch densities obtained by the density sensor. For this reason, the accuracy with which toner patch densities are measured by the density sensor greatly affects stability in image densities of prints.

On the other hand, examples of techniques required to measure toner patch densities using the density sensor include base correction. Aging variations in the surface gloss of a base on which toner is put (for example, an intermediate transfer unit 27 shown in FIG. 1) affects output values from the density sensor when toner patch densities are measured. Thus, with consideration given to aging variations in the surface gloss of the base, base correction is performed to cancel the effects on toner patch densities (sensor output values).

FIG. 12A is a diagram showing the relationship between the surface gloss of the base and the number of prints made by a printer. In the figure, the horizontal axis represents the number of prints made by the printer, and the vertical axis represents the average surface gloss of the base over one circumference thereof. As shown in the figure, the surface gloss of the base varies over time with the number of prints. This is considered to be because the rotating base is ground by toner, external additives, carriers, and the like remaining on a cleaning blade in a cleaning mechanism that picks up toner remaining on the base.

FIG. 12B is a diagram showing the relationship between the output from the density sensor and the number of prints made by a printer. In the figure, the horizontal axis represents the number of prints made by the printer, and the vertical axis represents the sensor output from the density sensor. As shown in the figure, sensor output values obtained by the density sensor reading toner patches with the same density formed on the base vary with the number of prints.

As will be understood from FIGS. 12A and 12B, aging variations in the surface gloss of the base affect sensor output values obtained by the density sensor reading toner patches with the same density formed on the base. The effects on the sensor output values can be cancelled using a base correction method described below.

Assume that an average value of sensor output values obtained by reading a surface of the base over one circumference (which means, for example, one circumference of an intermediate transfer unit) is R (base one-circumference average), and a sensor output value obtained by reading a toner patch is R (toner patch). In this case, a density DENS of a toner patch is calculated according to (Equation 01) given below. As a result, aging variations in sensor output values, which are obtained by reading toner patches with the same density, with aging variation of the base can be cancelled, and uniform toner densities can be obtained.

$$\text{DENS(toner patch)} = R\text{(toner patch)} \div R\text{(base one-circumference average)} \quad \text{(Equation 01)}$$

Further, there has been a base correction method that realizes more accurate density measurement as compared to the above described base correction method.

FIG. 13A is a diagram showing an exemplary sensor output profile obtained by the density sensor reading the base over one circumference thereof. In the figure, the horizontal axis represents base phase (position), and the vertical axis represents sensor output. As will be understood from FIG. 13A, the surface gloss of the base not only varies over time, but also originally has unevenness within one circumference. The inconsistency affects sensor output values when toner patches are read.

FIG. 13B is a diagram showing a state in which a sensor output profile obtained from the base over one circumference thereof and a sensor output profile obtained with a toner patch put on the base are superposed in phase with each other. As will be understood from FIG. 13B, unevenness in the surface gloss of the base manifests itself in sensor output values of a highlight toner patch. Unevenness in the surface gloss of the base does not manifest itself in sensor output values of a toner patch whose density is so high that toner covers the base, but tends to manifest itself in sensor output values of a highlight toner patch because the surface of the base is partially exposed from the patch.

By canceling the above described effects which unevenness in the surface gloss of the base has on sensor output values, higher accurate density measurement can be realized as compared to the above described base correction method using the average sensor output value over one circumference as expressed by (Equation 01).

According to Japanese Laid-Open Patent Publication (Kokai) No. 2004-117807, when densities of toner patches are to be measured, one circumference of the base is read in advance using the density sensor, and phases of the base and sensor output values in the respective phases are stored. Then, by referring to the stored phases and sensor output values in the respective phases during density measurement, the densities of the toner patches are obtained by performing base correction with sensor output values of the base directly below the toner patches grasped.

Base correction with sensor output values of the base directly below toner patches grasped (density measurement) is performed using a method described hereafter. When there are a regular reflected light output R (toner patch) when a toner patch is read and a regular reflected light output R (base directly below toner patch) when the base directly below the toner patch is read, a density DENS (toner patch) of the toner patch is calculated according to (Equation 02) given below.

$$\text{DENS(toner patch)}=R\text{(toner patch)}\div R\text{(base directly below toner patch)} \quad \text{(Equation 02)}$$

The toner patch density obtained by the above (Equation 2) is a density obtained with consideration given to the above described aging variations and unevenness within one circumference with respect to the base. Accurate density measurement can be realized using the above described base correction method.

To perform the above described base correction method considering aging variations of the base and unevenness within one circumference of the base, it is absolutely necessary to detect a phase of the base directly below a toner patch. To detect a phase of the base directly below a toner patch, it is necessary to rotate the intermediate transfer unit before forming the toner patch. For example, there has been a base correction method that rotates an intermediate transfer unit before forming a toner patch, measures a base profile for one circumference and base phases using a density sensor and a timer, forms a toner patch while continuing rotating the intermediate transfer unit, and measures the density of the toner patch.

However, the method that rotates the intermediate transfer unit before forming a toner patch, and measures a base profile for one circumference and base phases using the density sensor has the problem that the time period required for image density control increases because it is necessary to rotate the intermediate transfer unit before forming a toner patch.

SUMMARY OF THE INVENTION

The present invention provides an image forming apparatus that can reduce the time period for rotation of an intermediate transfer unit required before toner patches are formed, and measurement of toner patch densities while continuing the rotation.

Accordingly, a first aspect of the present invention provides an image forming apparatus comprising an image carrier configured to have a toner image formed thereon while rotating, a transfer member configured to be conveyed in a conveying direction while being in contact with the rotating image carrier, a transfer unit configured to transfer the toner image formed on the image carrier to a surface of the transfer member, a correction unit configured to form a toner image for detection on the image carrier, and correct image forming conditions based on an amount of toner obtained by reading the toner image for detection transferred to the transfer member by the transfer unit, a first reading unit configured to be disposed upstream of the transfer unit in the conveying direction of the transfer member, and read the surface of the transfer member being conveyed in the conveying direction, a second reading unit configured to be disposed downstream of the transfer unit in the conveying direction of the transfer member, and read the surface of the transfer member being conveyed in the conveying direction, a storage unit configured to store outputs from the first reading unit as a first profile, and store outputs from the second reading unit as a second profile, and a toner density calculation unit configured to calculate a toner density of the toner image for detection based on the first profile and the second profile stored in the storage unit, wherein the correction unit corrects image forming conditions based on the toner density calculated by the toner density calculation unit.

Accordingly, a second aspect of the present invention provides an image forming apparatus comprising a plurality of image carriers each configured to have a toner image formed thereon while rotating, a transfer member configured to be conveyed in a conveying direction while being in contact with the plurality of rotating image carriers, a plurality of transfer units configured to transfer the toner images formed on the plurality of image carriers in a superposed manner on a surface of the transfer member, a correction unit configured to form toner images for detection on the image carriers, and correct image forming conditions based on an amount of toner by reading the toner images for detection transferred to the transfer member by the transfer unit, a first reading unit configured to be disposed upstream of the plurality of transfer units in the conveying direction of the transfer member, and read the surface of the transfer member being conveyed in the conveying direction, a plurality of second reading units configured to be disposed downstream of respective ones of the plurality of transfer units in the conveying direction of the transfer member, and read the surface of the transfer member being conveyed in the conveying direction, a storage unit configured to store outputs from the first reading unit as a first profile, and store outputs from the second reading unit as a second profile, and a toner density calculation unit configured to calculate toner densities of the toner images for detection based on the first profile and the second profile stored in the storage unit, wherein the correction unit corrects image forming conditions based on the toner densities calculated by the toner density calculation unit.

According to the present invention, the time period for rotation of an intermediate transfer unit is required before toner patches are formed, and toner patch densities are measured while continuing the rotation.

Moreover, degradation in the accuracy with which toner patch densities are measured can be prevented from occurring with fogging stains put on surfaces of toner patches having passed through photosensitive drums.

Further features of the present invention will become apparent from the following description of exemplary embodiments (with reference to the attached drawings).

DESCRIPTION OF THE EMBODIMENTS

The present invention will now be described in detail with reference to the drawings showing embodiments thereof.

Figure 1:
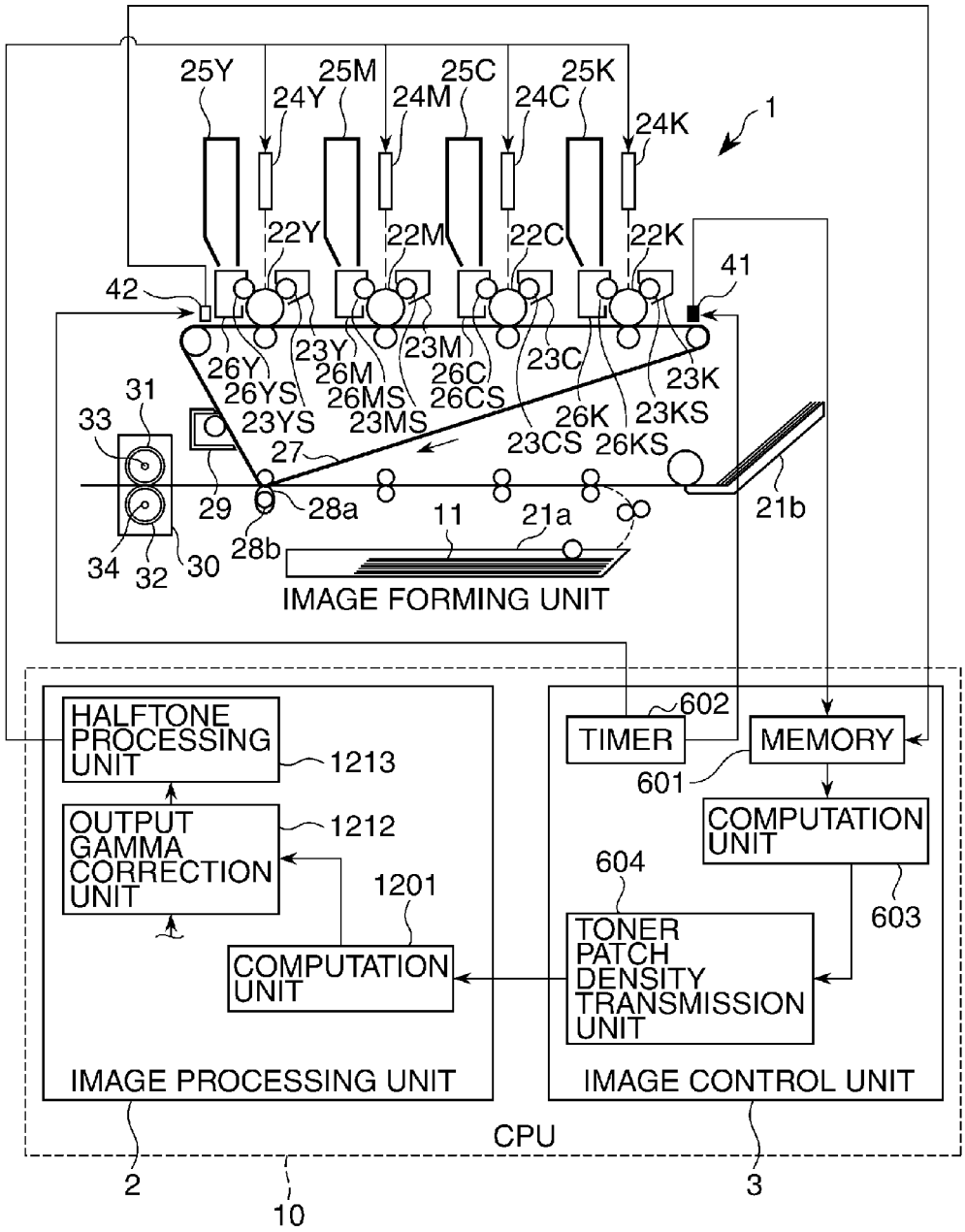
FIG. 1 is a diagram schematically showing an overall arrangement of an image forming apparatus according to a first embodiment of the present invention.

FIG. 1 is a diagram schematically showing an overall arrangement of an image forming apparatus according to a first embodiment of the present invention.

The image forming apparatus according to the first embodiment of the present invention is an electrophotographic color image forming apparatus of a tandem type adopting an intermediate transfer unit. Referring to FIG. 1, the image forming apparatus is comprised of an image forming unit 1, an image processing unit 2, and an image control unit 3. The image processing unit 2 and the image control unit 3 are comprised of a CPU 10.

First, a description will be given of how the image forming unit 1 operates.

The image forming unit 1 has sheet feeding units 21*a* and 21*b*, and photosensitive drums 22Y, 22M, 22C, and 22K, injection charging units 23Y, 23M, 23C, and 23K, and toner cartridges 25Y, 25M, 25C, and 25K of respective stations for development colors which are disposed parallelly. The image forming unit 1 also has developers 26Y, 26M, 26C, and 26K, an intermediate transfer unit 27, a transfer roller (28*a*, 28*b*), a cleaning mechanism 29, a fixing unit 30, density sensors 41 and 42, and a scanner unit, not shown, for scanning in sheet originals and the like.

The image forming unit 1 forms electrostatic latent images by exposure light which is lit based on the time of exposure converted by the image processing unit 2. The electrostatic latent images are developed to form one-color toner images, and the one-color toner images are superposed to form a multicolor toner image. Then, the multicolor toner image is transferred to a transfer material 11, and the multicolor toner image on the transfer material 11 is fixed.

The photosensitive drums (image carriers) 22Y, 22M, 22C, and 22K are each comprised of an aluminum cylinder whose outer periphery is coated with an organic photoconductive layer, and rotatively driven by drive motors, not shown. The drive motors rotatively drive the photosensitive drums 22Y, 22M, 22C, and 22K counterclockwise in accordance with an image forming operation. The injection charging units 23Y, 23M, 23C, and 23K act as primary charging units which electrically charge the yellow (Y), magenta (M), cyan (C), and black (K) photosensitive drums 22Y, 22M, 22C, and 22K. The injection charging units 23Y, 23M, 23C, and 23K are provided with sleeves 23YS, 23MS, 23CS, and 23KS, respectively.

Exposure light for the photosensitive drums 22Y, 22M, 22C, and 22K is sent from laser units 24Y, 24M, 24C, and 24K to selectively expose surfaces of the photosensitive drums 22Y, 22M, 22C, and 22K to light, thus forming electrostatic latent images. The developers 26Y to 26K act as developer units which perform yellow (Y), magenta (M), cyan (C), and black (K) processing so as to transform electrostatic latent images into visual images by toner. The developers 26Y, 26M, 26C, and 26K form toner images on the surfaces of the photosensitive drums 22Y, 22M, 22C, and 22K. The developing units are provided with sleeves 26YS, 26MS, 26CS, and 26KS, respectively. Moreover, the developers 26Y, 26M, 26C, and 26K are removable.

The intermediate transfer unit 27 is in contact with the photosensitive drums 22Y, 22M, 22C, and 22K, and when a color image is to be formed, rotates clockwise with rotation of the photosensitive drums 22Y, 22M, 22C, and 22K, so that one-color toner images are transferred to the intermediate transfer unit 27. After that, the transfer rollers 28*a* and 28*b*, described later, come into contact with the intermediate transfer unit 27 to convey the transfer material 11 while sandwiching the same, so that a multicolor image on the intermediate transfer unit 27 is transferred to the transfer material 11. While the multicolor image is being transferred to the transfer material 11, the transfer rollers 28*a* and 28*b* are in abutment with the transfer material 11, and after a printing process, come away from the transfer material 11.

The fixing unit 30 fixes the transferred multicolor image through heat fusion while conveying the transfer material 11, and as shown in FIG. 1, has a fixing roller 31 for heating the transfer material 11, and a pressurizing roller 32 for bringing the transfer material 11 into urging contact with the fixing roller 31. The fixing roller 31 and the pressurizing roller 32 are formed into hollow shapes, and have heaters 33 and 34, respectively, incorporated therein. Namely, the transfer material 11 holding the multicolor image is conveyed by the fixing roller 31 and the pressurizing roller 32, and is applied with heat and pressure, so that the toner is fixed on a surface of the transfer material 11. After the toner image is fixed on the transfer material 11, the transfer material 11 is discharged onto a discharged sheet tray, not shown, by discharging rollers, not shown, which completes the image forming operation.

The cleaning mechanism 29 removes toner remaining on the intermediate transfer unit 27, and after a multicolor toner image of four colors formed on the intermediate transfer unit 27 is transferred to the transfer material 11, waste toner is stored in a cleaner case.

It should be noted that an image conveying speed (process speed) of the color image forming apparatus used in the present embodiment is set at 246 mm/sec.

Figure 2A:
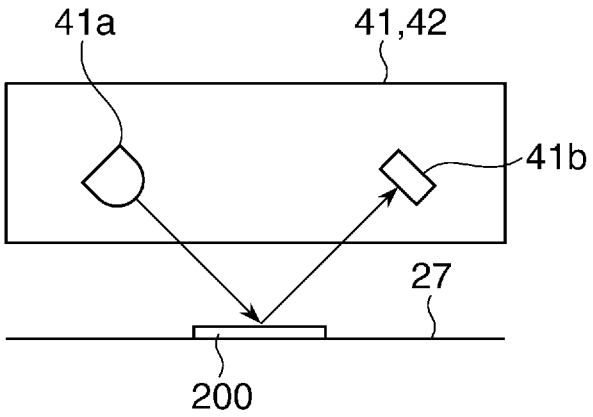
FIG. 2A is a diagram showing an exemplary arrangement of a density sensor.

The density sensors 41 and 42 are optical sensors for reading toner patches (toner images for detection) formed on a surface of the intermediate transfer unit 27, and measuring toner patch densities from sensor output values obtained by reading the toner patches. In the image forming unit 1, the density sensor 42 is disposed upstream of transfer positions at which toner images formed on the photosensitive drums 22Y, 22M, 22C, and 22K are transferred to the surface of the intermediate transfer unit 27 in the conveying direction of the intermediate transfer unit 27, and acts as a first reading unit to read the surface of intermediate transfer unit 27 conveyed in the conveying direction. The density sensor 41 is disposed downstream of transfer positions at which toner images formed on the photosensitive drums 22Y, 22M, 22C, and 22K are transferred to the surface of the intermediate transfer unit 27 in the conveying direction of the intermediate transfer unit 27, and acts as a second reading unit to read the surface of intermediate transfer unit 27 conveyed in the conveying direction. The density sensors 41 and 42 are disposed at such locations as to face the surface of the intermediate transfer unit 27. FIG. 2A shows an exemplary arrangement of the density sensors 41 and 42.

Referring to FIG. 2A, the density sensors 41 and 42 have a light-emitting unit 41*a* comprised of an infrared light-emitting device such as an LED, and a light-receiving unit 41*b* comprised of a light-receiving device such as a photodiode. The density sensors 41 and 42 also have an IC (not shown) that processes light receiving data, and holders (not shown) for holding the light-emitting unit 41*a*, the light-receiving unit 41*b*, and the like.

The light-emitting unit 41*a* is disposed at an angle of 45 degrees with respect to a direction vertical to the intermediate transfer unit 27, and irradiates the surface of the intermediate transfer unit 27 with infrared light. The light-receiving unit 41*b* is disposed symmetrically with respect to the light-emitting unit 41*a*, and receives regular reflected light from the intermediate transfer unit 27. The density sensors 41 and 42 output voltages of up to 5 V. It should be noted that an optical device such as a lens (not shown) may be used to join the light-emitting unit 41*a* and the light-emitting unit 41*a* together.

In the present embodiment, the intermediate transfer unit 27 is a polyimide single-layer resin belt with a circumferential length of 895 mm. Moreover, a proper amount of carbon impalpable particles are dispersed in the resin so as to adjust belt resistance, and a surface color is black. Further, the surface of the intermediate transfer unit 27 is smooth and gloss, and has a gloss level of about 100% (measured using a glossmeter manufactured by Horiba, Ltd.).

The density sensors 41 and 42 are configured such that, when the surface of the intermediate transfer unit 27 exposes itself (where the amount of toner is zero), the light-receiving unit 41*b* receives regular reflected light from the intermediate transfer unit 27. This is because the surface of the intermediate transfer unit 27 has a gloss. On the other hand, when a toner image 200 is formed on the intermediate transfer unit 27, regular reflected light output gradually decreases as the density of the toner image (the amount of toner) increases. This is because the toner covers up the surface of the intermediate transfer unit 27 to decrease the regular reflected light from the belt surface.

Figure 12A:
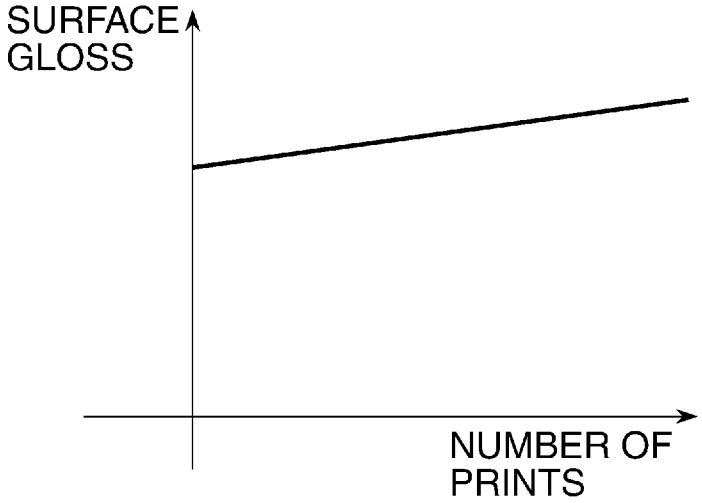
FIG.12A PRIOR ART
FIG. 12A is a diagram showing the relationship between base surface gloss and printer endurance sheet count.
Figure 12B:
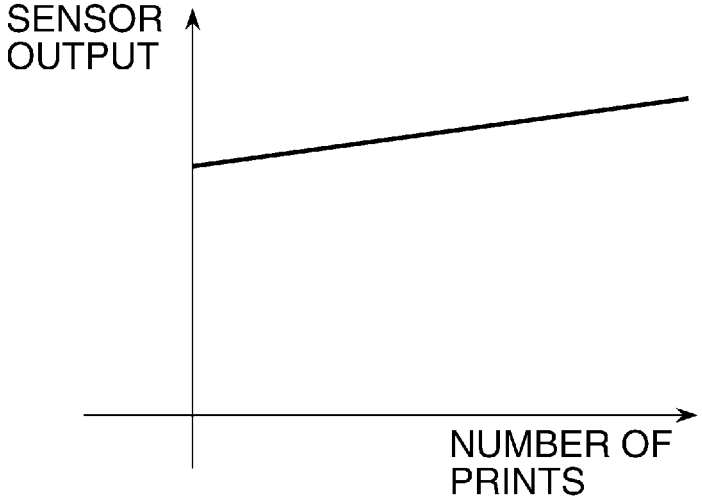
FIG.12B PRIOR ART
FIG. 12B is a diagram showing the relationship between density sensor output and printer endurance sheet count.
Figure 13A:
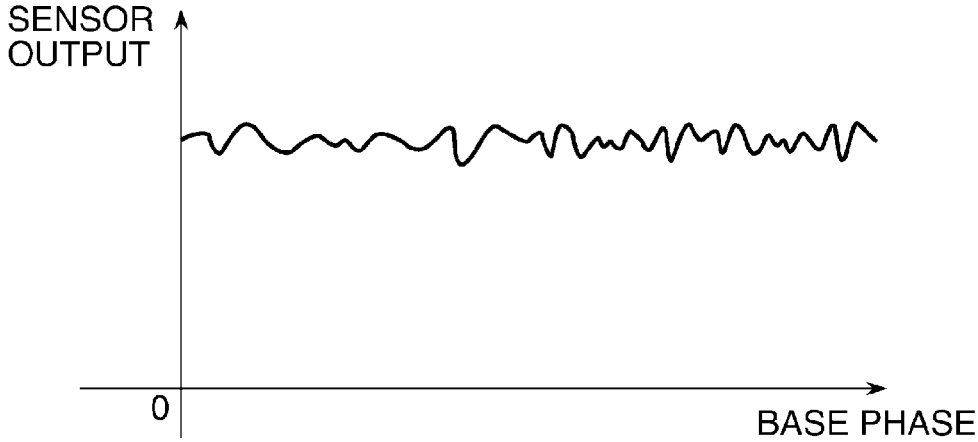
FIG.13A PRIOR ART
FIG. 13A is a diagram showing an exemplary sensor output profile obtained by a density sensor reading of a base over one circumference thereof.
Figure 13B:
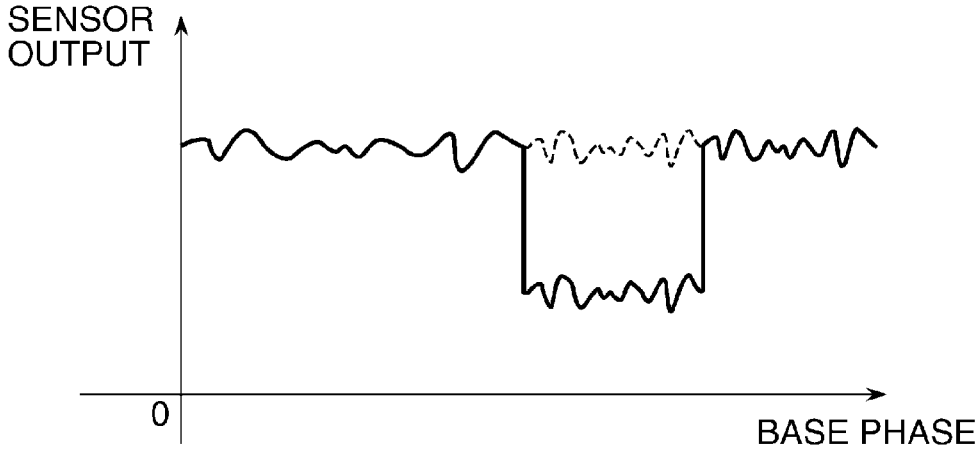
FIG.13B PRIOR ART
FIG. 13B is a diagram showing a state in which the sensor output profile obtained by reading the base over one circumference thereof and a sensor output profile obtained with a toner patch put on the base are superposed in phase with each other.

Moreover, even when the amount of toner is the same, regular reflected light output from toner patches varies according to surface conditions of the intermediate transfer unit 27. This is because the light-receiving unit 41*b* picks up a surface gloss of the intermediate transfer unit 27 which exposes itself in a toner patch. As described earlier with reference to FIGS. 12A and 12B, even when toner patches have the same amount of toner, the higher is a surface gloss level of the intermediate transfer unit 27 directly below a toner patch, the greater is regular reflected light output, and as a result, it is determined that the density of the toner patch is low. To prevent a toner patch density reading error from occurring due to this phenomenon, the following process is carried out.

In the present embodiment, a toner patch density DENSi (toner patch) is calculated according to (Equation 03) given below using a regular reflected light output Ri (toner patch) when a toner patch is read, and a regular reflected light output Ri (base directly below toner patch) when the surface of the intermediate transfer unit 27 directly below the toner patch is read.

$$\text{DENSi(toner patch)}=\text{Ri(toner patch)}\div\text{Ri(base directly below toner patch)} \quad \text{(Equation 03)}$$

In (Equation 03), a symbol i represents a sampling number in the same toner patch, and in the present embodiment, sampling is carried out ten times in total. It should be noted that sampling of regular reflected light measured by the density sensors 41 and 42 is carried out at an interval of 4 msec. Further, the final toner patch density DENS_ave (toner patch) is expressed by following (Equation 04) using an average of the ten-times sampling.

$$\text{DENS_ave(toner patch)}=\Sigma(\text{DENSi(toner patch)})\div 10 \quad \text{(Equation 04)}$$

Figure 2B:
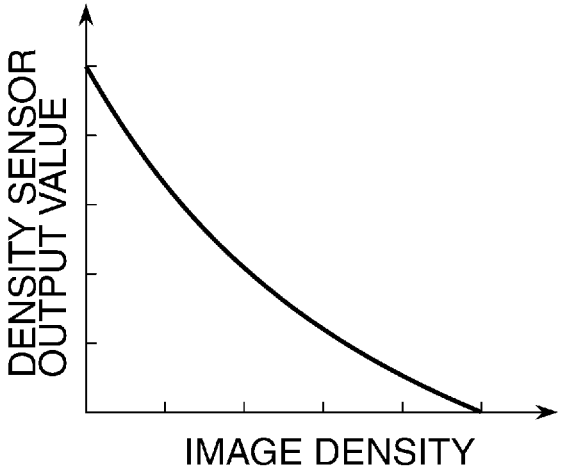
FIG. 2B is a diagram showing the relationship between detected value from the density sensor and image density (amount of toner).

FIG. 2B shows the relationship between output value from the density sensors 41 and 42 (here, value calculated according to (Equation 04)) and the amount of toner. In FIG. 2B, the vertical axis represents output value from the density sensors, and the horizontal axis represents image density (corresponding to the amount of toner). Values obtained according to (Equation 04) correspond to values represented by the vertical axis in FIG. 2B, and the actual toner patch densities are values represented by the horizontal axis obtained by referring to a curve in FIG. 2B. The curve in FIG. 2B is held in a ROM (not shown) in the image processing unit 2. It should be noted that calculations based on the above (Equation 03) and (Equation 04) are performed by the image control unit 3.

Next, a description will be given of how the image control unit 3 operates.

The image control unit 3 carries out overall image density control in the present embodiment. In the image density control, various image forming conditions are given feedback based on toner patch densities obtained by the density sensors 41 and 42. Referring to FIG. 1, the image control unit 3 is comprised of a memory 601, a computation unit 603, a toner patch density transmission unit 604, and a timer 602. A detailed description will now be given of elements constituting the image control unit 3.

Figure 3A:
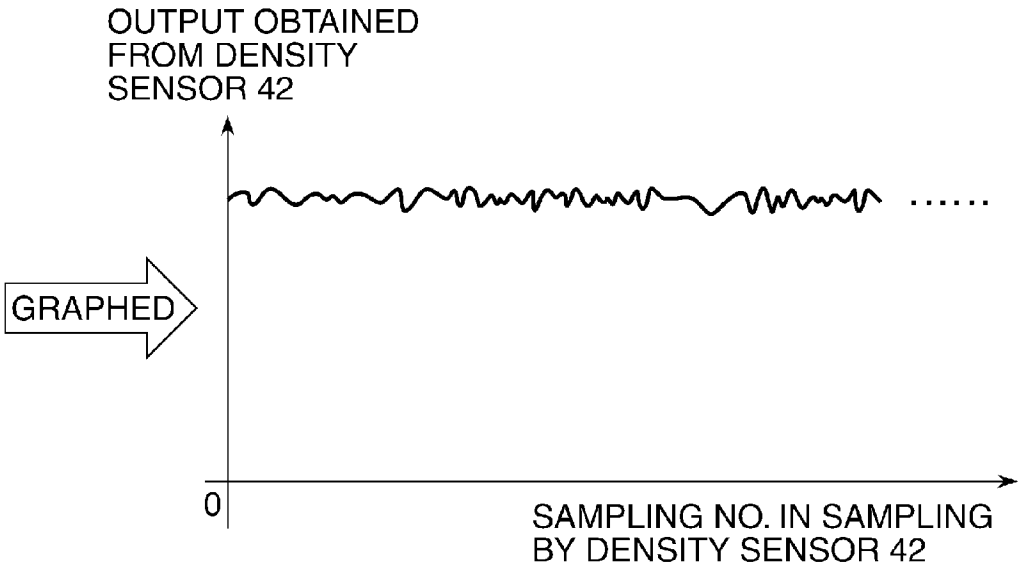
FIGS. 3A and 3B are diagrams outlining a base profile and a toner patch profile.
Figure 3B:
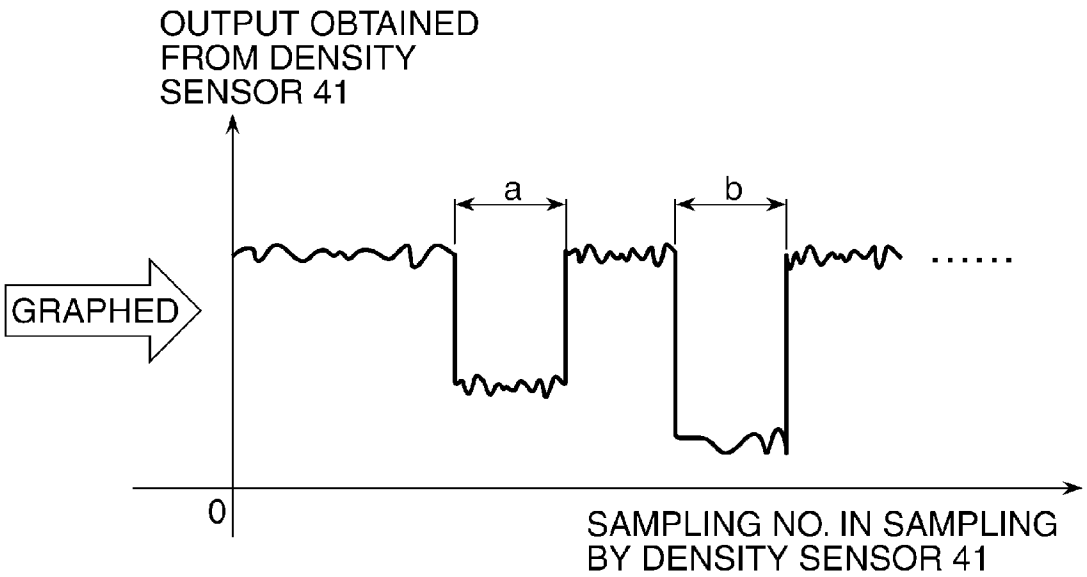

The memory 601 stores regular reflected light outputs from a base read by the density sensor 42 as a base profile. For example, it is assumed that the base profile is a first profile. The memory 601 also stores regular reflected light outputs from toner patches (and a base) read by the density sensor 41 as a toner patch profile. For example, it is assumed that the toner patch profile is a second profile. FIGS. 3A and 3B outline the base profile and toner patch profile, respectively. Both profiles are in phase with each other on the intermediate transfer unit. When both profiles are compared with each other, they indicate the same values in regions other than regions a and b on which toner is put in the toner patch profile as shown in FIG. 3B. It should be noted that the memory 601 also has a function of controlling for minute phase differences between both profiles occurring when the conveying speed of the intermediate transfer unit 27 fluctuates, and bringing both profiles in phase with each other. Further, the memory 601 stores a sheet counter C, described later.

Figure 4:
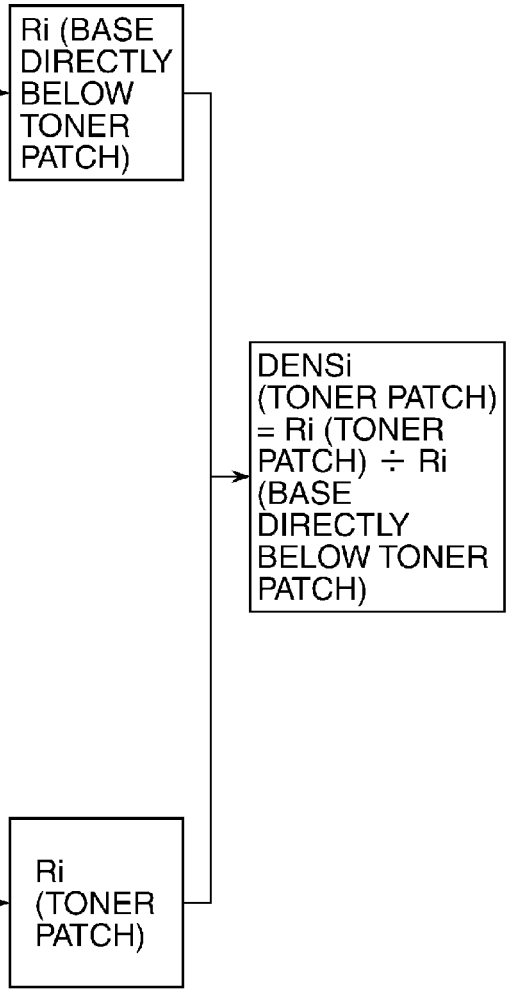
FIG. 4 is a diagram outlining a method by which a computation unit calculates toner patch densities.

Based on the base profile and the toner patch profile stored in the memory 601, the computation unit 603 calculates the densities of toner patches read by the density sensor 41. The computation unit 603 is an exemplary toner density calculation unit. FIG. 4 outlines a method by which the computation unit 603 calculates toner patch densities.

Referring to FIG. 4, the computation unit 603 refers to, from the base profile, a regular reflected light output Ri (base directly below toner patch) when a surface of the intermediate transfer unit 27 directly below a toner patch is read, and refers to, from the toner patch profile, a regular reflected light output Ri (toner patch) when the toner patch is read. Then, the computation unit 603 calculates a toner patch density DENSi (toner patch) according to the above (Equation 03) using the regular reflected light output Ri (toner patch) when the toner patch is read, and the regular reflected light output Ri (base directly below toner patch) when the surface of the intermediate transfer unit 27 directly below the toner patch is read.

In the above (Equation 03), the symbol i represents an in-profile sampling number, and in the present embodiment, a total of ten sampling points in the same toner patch are used in series. It should be noted that sampling of regular reflected light measured by the density sensors 41 and 42 is carried out at an interval of 4 msec. The computation unit 603 calculates the final toner patch density DENS_ave (toner patch) according to the above (Equation 04) using an average of the above described ten-times sampling.

The toner patch density transmission unit 604 transmits the toner patch density obtained by the computation unit 603 to the CPU (not shown) in the image processing unit 2.

Figure 5:
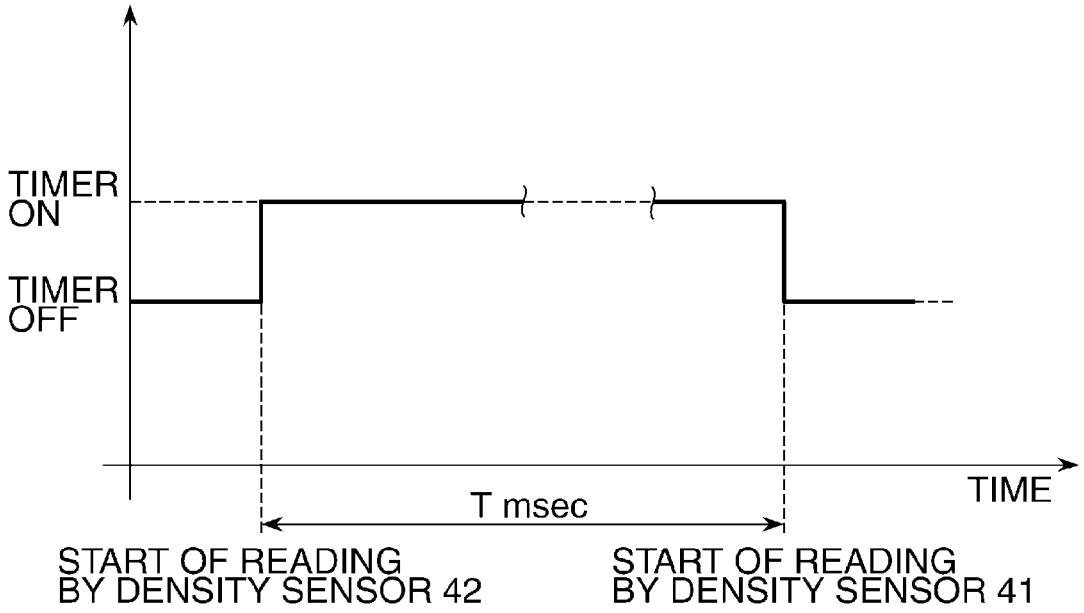
FIG. 5 is a diagram showing a time period from when a certain predetermined position (phase) on an intermediate transfer unit is read by a density sensor 42 to when the position is read by a density sensor 41.

As shown in FIG. 5, the timer 602 measures a time period Tmsec from when a certain predetermined position (phase) on the intermediate transfer unit 27 is read by the density sensor 42 to when the position is read by the density sensor 41. The time period Tmsec corresponds to a time period obtained by dividing the distance between the density sensor 41 and the density sensor 42 by the process speed.

Next, a description will be given of how the image processing unit 2 operates.

Figure 6:
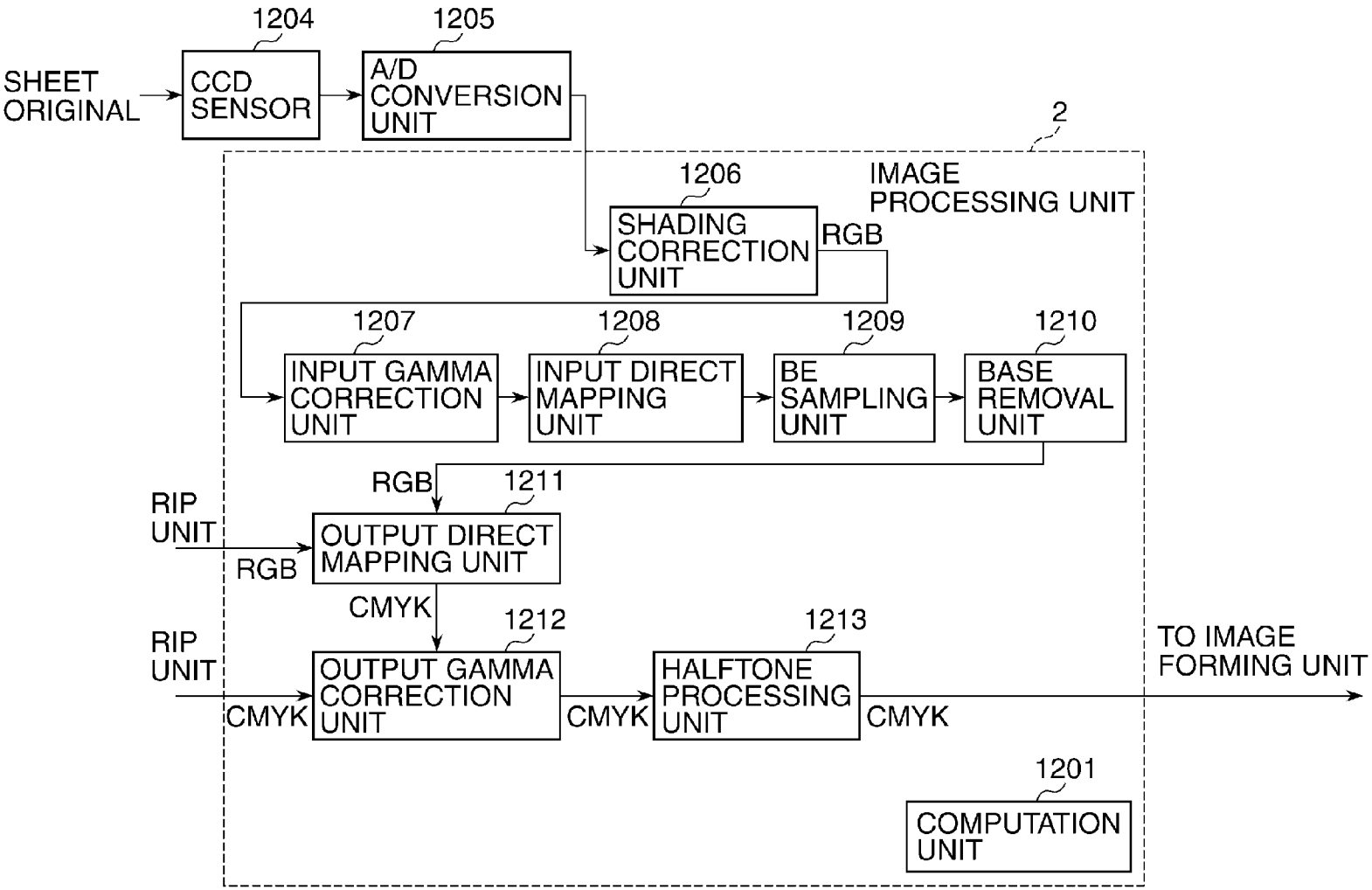
FIG. 6 is a block diagram schematically showing an internal arrangement of an image processing unit.

FIG. 6 is a block diagram schematically showing an internal arrangement of the image processing unit 2. A description will now be given of elements constituting the image processing unit 2 with reference to FIG. 6.

A computation unit 1201 centrally controls component elements of the image processing unit 2 using a RAM (not shown) as a work memory based on control programs stored in a ROM (not shown). A sheet original scanned in by the scanner unit (not shown) is converted into an electric signal by a CCD sensor 1204, which is an RGB 3-line color sensor. The electric signal is input as R (Red), G (Green), and B (Blue) image data to an A/D conversion unit 1205. The CCD sensor 1204 and the A/D conversion unit 1205 are incorporated in the scanner unit (not shown) in the image forming unit 1.

The A/D conversion unit 1205 carries out gain adjustment and offset adjustment on the image data, and then converts the image data to 8-bit digital image data for each color signal. A shading correction unit 1206 corrects for variations in the sensitivity of pixels of the CCD sensor 1204, variations in the light quantity of an original illumination lamp, and the like for each color using signals obtained by reading a reference white board (not shown). An input gamma correction unit 1207 is a one-dimensional lookup table (LUT: lookup table) that performs correction on RGB inputs so that light exposure and luminance can exhibit a linear relationship. An input direct mapping unit 1208 is a three-dimensional LUT that converts input RGB signals into in-device RGB signals so as to unify a color space.

The input direct mapping unit 1208 is also a portion that converts a read color space, which is determined by spectral characteristics of RGB filters of the CCD sensor 1204, into a standard color space such as sRGB. The input direct mapping unit 1208 can absorb various characteristics such as sensitivity characteristics of the CCD sensor 1204 and spectrum characteristics of the illumination lamp.

A BE (background erase) sampling unit 1209 discretely samples pixels in a designated rectangular region to create a luminance histogram. This is a background. A base removal unit 1210 performs nonlinear conversion on RGB image data scanned in by the scanner unit so as to erase the background based on the histogram created by the BE sampling unit 1209. An output direct mapping unit 1211 converts the RGB image data into CMYK image data. In the conversion, RGB values are input to a lookup table, and a cyan (C) component is created from the sum total of the output values. Similarly, magenta (M), yellow (Y), and black (K) components are formed by using the lookup table and performing summation operation.

An output gamma correction unit 1212 performs density correction on an output image in a manner suitable for a printer. The output gamma correction unit 1212 plays a role in maintaining linearity of output image data varying with image forming operations based on CMYK one-dimensional lookup tables stored in advance.

It should be noted that the CMYK one-dimensional lookup tables mentioned above are updated as the need arises based on a predetermined process carried out by the computation unit 1201 at times when the toner patch density transmission unit 604 in the image control unit 3 transmits a toner patch density to the computation unit 1201. The process carried out by the computation unit 1201 will be described later.

A halftone processing unit 1213 can selectively use various types of screening varying according to functions. In general, screening of an error diffusion type which hardly causes more is used for copying or the like. On the other hand, screening of a multi-bit screening type using a dither matrix for printing or the like in many cases with consideration given to reproducibility of characters and thin lines. The former is a method that weights a target pixel and its surrounding pixels using an error filter, and performs correction by distributing errors in multilevel processing while maintaining the number of tones. The latter is a method that sets threshold values of a dither matrix for a multi-level image, and expresses a pseudo halftone, and in the present embodiment, conversion is performed on CMYK independently of each other, and switching between high LPI and low LPI is allowed.

Figure 7A:
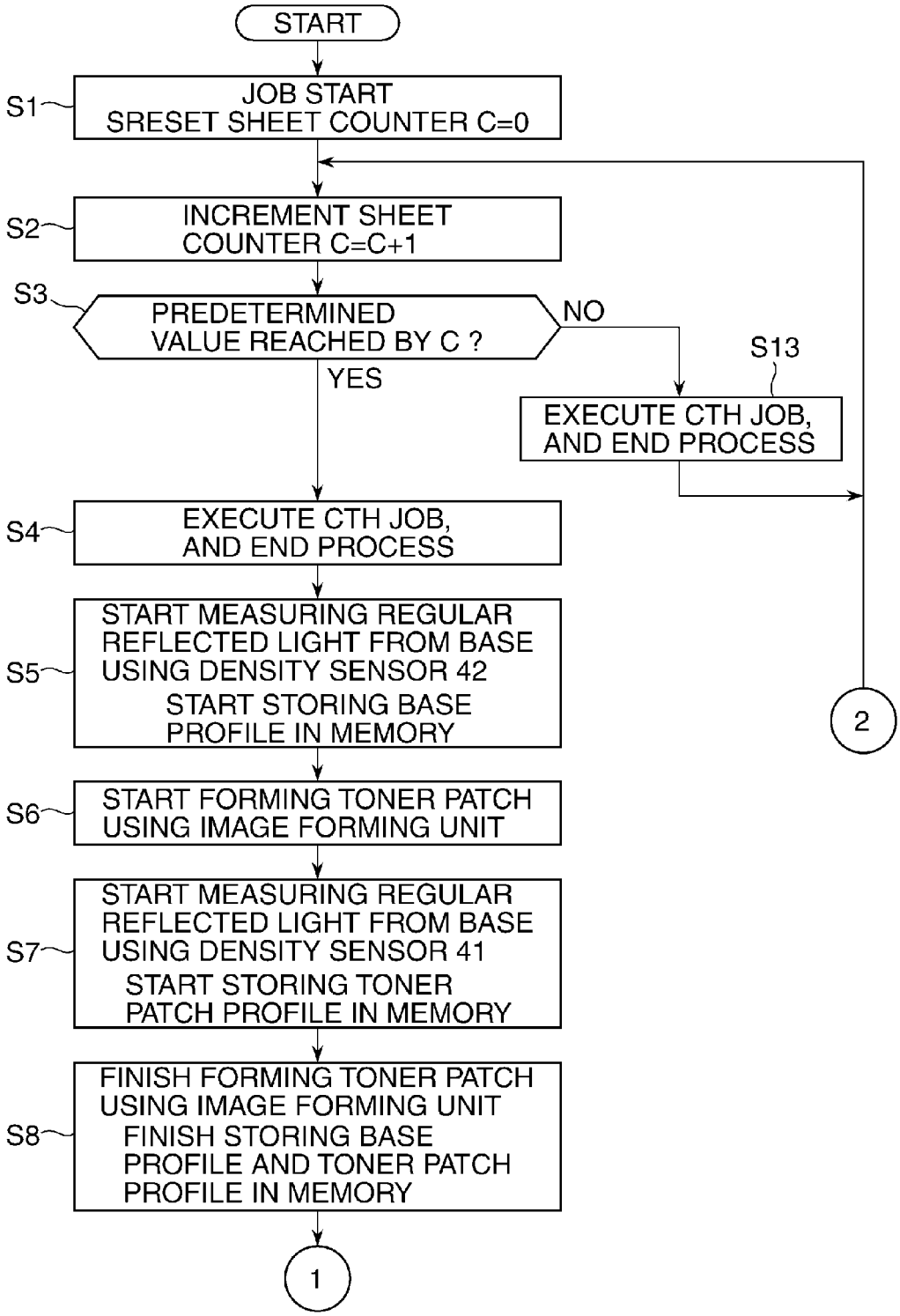
FIGS. 7A and 7B are flowcharts of image density control provided by an image forming unit and a CPU.
Figure 7B:
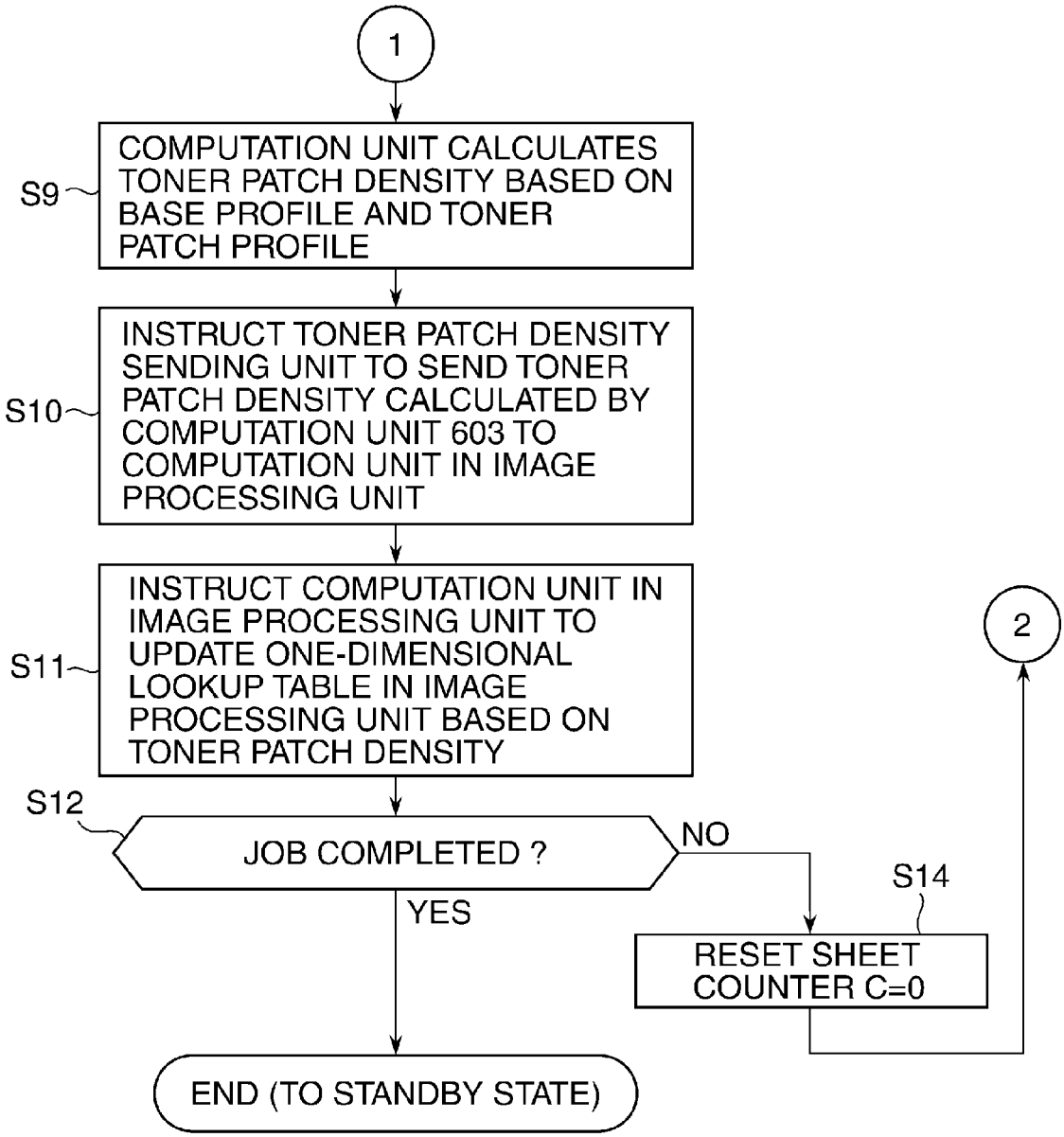

Referring next to flowcharts of FIGS. 7A and 7B, a description will be given of image density control carried out by the CPU 10 (the image processing unit 2 and the image control unit 3).

In step S1, after power supply to the image forming apparatus is turned on, the image forming unit 1 and the CPU 10 are brought into a standby state, and a job starts in response to a print instruction given by a user. When the job starts, the CPU 10 accesses the sheet counter stored in the memory 601 in the image control unit 3, and starts counting the number of sheets in the job. In the present embodiment, the sheet counter is managed using a parameter C, and first, the CPU 10 resets the parameter C to zero.

In step S2, the CPU 10 increments the parameter C by 1.

In step S3, the CPU 10 determines whether or not the parameter C is a predetermined value or not. In the present embodiment, it is configured such that when the number of jobs reaches 100 A4-size sheets, the image density control is carried out, and thus, the predetermined value is set at 100. The CPU 10 determines whether or not the present job being in process of image formation is a 100th job. When, as a result of the determination, the present job being in process of image formation is a 100th job, the CPU 10 proceeds to step S4. On the other hand, when, as a result of the determination, the present job being in process of image formation is not a 100th job, the CPU 10 instructs the image forming unit 1 to execute the present job (the Cth job) and then terminate the process (step S13), and returns to step S2.

In step S4, the CPU 10 instructs the image forming unit 1 to execute the Cth job and then terminate the process.

Figure 8A:
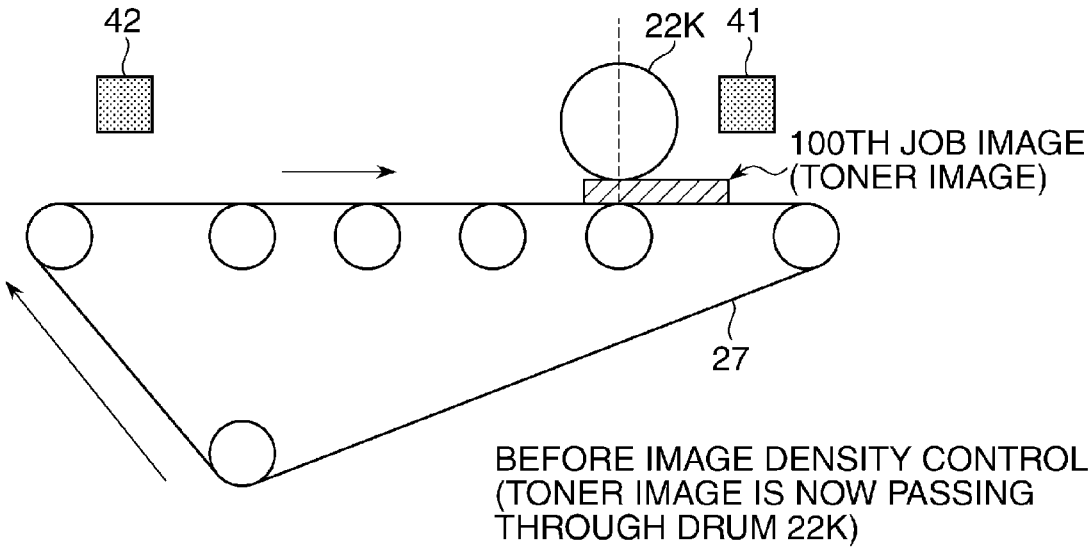
FIG. 8A is a diagram showing the positional relationship between a photosensitive drum 22K and a 100th toner image on the intermediate transfer unit before the image density control.
Figure 8B:
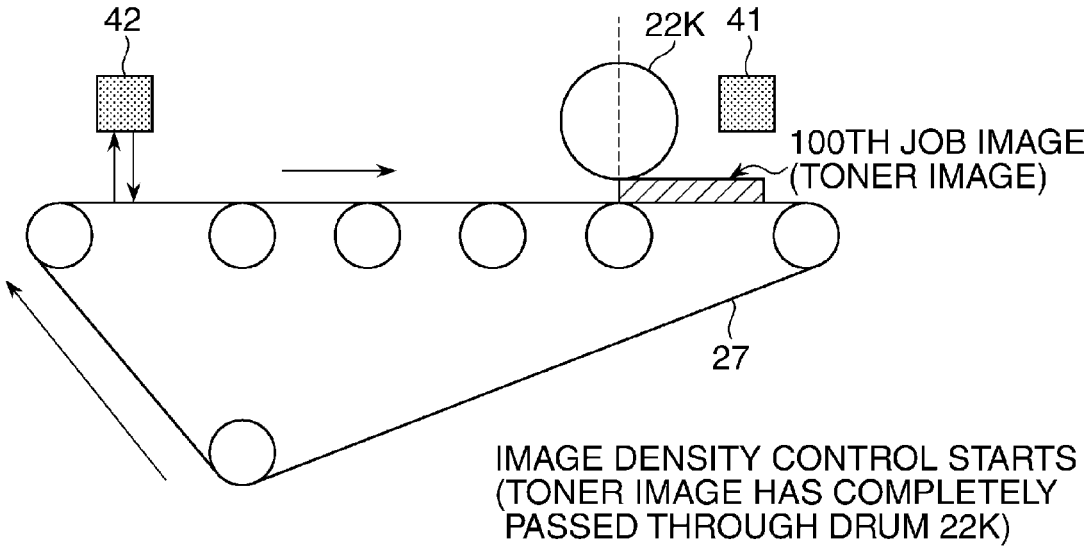
FIG. 8B is a diagram showing the positional relationship between the photosensitive drum 22K and the 100th toner image on the intermediate transfer unit when the image density control starts.

In step S5, the CPU 10 starts the image density control. Referring to FIGS. 8A and 8B, it is assumed that a time immediately after the photosensitive drum 22K located most downstream in the conveying direction of the intermediate transfer unit 27 finishes forming a 100th job image (toner image) is a starting time. Using this starting time as a flag, the CPU 10 instructs the density sensor 42 to start measuring regular reflected light from a surface of the intermediate transfer unit 27 continuously rotating with no toner put thereon, that is, a background (FIG. 8B). At the same time, the CPU 10 instructs the memory 601 in the image control unit 3 to store, point by point, the regular reflected light from the background measured by the density sensor 42 as a background profile.

Figure 9:
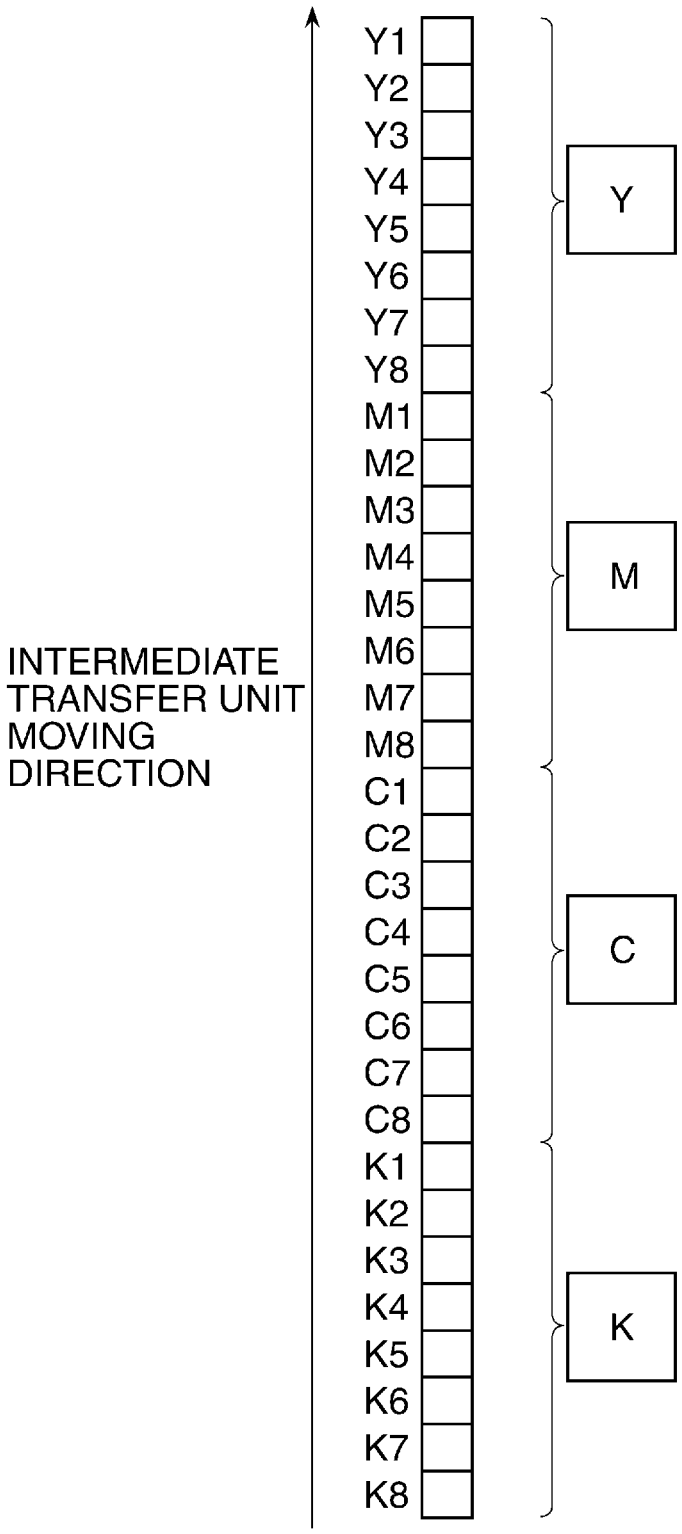
FIG. 9 is a diagram showing an exemplary toner patch pattern formed on the intermediate transfer unit.

In step S6, the CPU 10 instructs the image forming unit 1 to start forming image density control toner patches. FIG. 9 shows a toner patch pattern formed on the intermediate transfer unit 27. Referring to FIG. 9, 25 mm square patches with eight different coverage rates (density gradations) are formed for each of Y, M, C, and K colors (8 patches for each color), and a total of 32 patches are formed on a portion at which the density sensor 41 is disposed.

The correspondence relationship between each patch and coverage rate (gradation) is set as follows: Y1, M1, C1, K1=12.5%, Y2, M2, C2, K2=25%, Y3, M3, C3, K3=37.5%, Y4, M4, C4, K4=50%, Y5, M5, C5, K5=62.5%, Y6, M6, C6, K6=75%, Y7, M7, C7, K7=87.5%, and Y8, M8, C8, K8=100%. In the present embodiment, after the density sensor 42 starts measurement in the step S5, the image forming unit 1 causes the photosensitive drum 22Y to start forming a toner patch according to a color order of the toner patch pattern.

In step S7, the CPU 10 instructs the density sensor 41 to start measuring regular reflected light from the toner patch of which formation was started in step S6. It should be noted that the timing with which the density sensor 41 starts measurement is managed by the timer 602 in the image control unit 3. The timer 602 measures the time period Tmsec from when a certain predetermined position (phase) on the surface of the intermediate transfer unit 27 is read by the density sensor 42 to when the position is read by the density sensor 41. As described earlier, the timer period Tmsec corresponds to a time period obtained by dividing the distance between the density sensor 41 and the density sensor 42 by the process speed.

The density sensor 41 starts measuring regular reflected light at the time when the time period measured by the timer 602 is such that T=Tmsec where the above described image density control starting timing in step S5 is T=0 (zero). At the same time, the CPU 10 instructs the memory 601 in the image control unit 3 to sequentially store regular reflected light from the toner patches (including the base) measured by the density sensor 41 as a toner patch profile.

It should be noted that the base profile of which storage was started in step S5 and the toner patch profile of which storage was started in step S7 are made to be in phase with each other on the intermediate transfer unit by controlling the measurement starting timing of the density sensors 41 and 42 using the time period Tmsec. In step S9, described later, the CPU 10 causes the computation unit 603 to calculate toner patch densities, and in this case, the computation unit 603 can easily perform base correction using (Equation 03) because both profiles are in phase on the intermediate transfer unit when the computation unit 603 refers to both profiles for density calculation.

In step S8, the CPU 10 instructs the image forming unit 1 to complete the formation of the image density control toner patches shown in FIG. 9. With the completion of the formation of the toner patches, the CPU 10 instructs the memory 601 to complete the storage of the base profile. Moreover, after a toner patch lying at the final position among the toner patches passes through the density sensor 41, the CPU 10 instructs the memory 601 to complete the storage of the toner patch profile.

In step S9, the CPU 10 instructs the computation unit 603 to calculate densities of the toner patches based on the base profile and the toner patch profile obtained in steps S5 and S7. As described earlier with reference to FIG. 4, the computation unit 603 refers to a regular reflected light output Ri (base immediately below toner patch) when a surface of the intermediate transfer unit 27 directly below a toner patch is read from the base profile, and a regular reflected light output Ri (toner patch) when a toner patch is read from the toner patch profile. Then, the computation unit 603 calculates a toner patch density DENSi (toner patch) according to the above (Equation 03) using the regular reflected light output Ri (base immediately below toner patch) when the surface of the intermediate transfer unit 27 directly below the toner patch is read, and the regular reflected light output Ri (toner patch) when the toner patch is read.

In the above (Equation 03), a mark i represents an in-profile sampling number, and in the present embodiment, a total of 10 sampling points in the same toner patch are used (It should be noted that sampling of regular reflected light measured by the density sensors 41 and 42 is carried out at an interval of 4 msec). The computation unit 603 calculates a final toner patch density DENS_ave (toner patch) according to the above (Equation 04) using an average of the above-mentioned ten-times sampling.

The computation unit 603 performs the sequential calculations according to (Equation 03) and (Equation 04) with respect to each of toner patches consecutively formed in the direction in which the intermediate transfer unit 27 is conveyed, thus calculating toner patch densities.

In step S10, the CPU 10 instructs the toner patch density transmission unit 604 in the image control unit 3 to transmit the toner patch densities calculated by the computation unit 603 to the computation unit 1201 in the image processing unit 2.

In step S11, the CPU 10 instructs the computation unit 1201 in the image processing unit 2 to update, based on the received toner patch densities, the one-dimensional lookup tables for the respective CMYK colors stored in the output gamma correction unit 1212 in the image processing unit 2.

Figure 10:
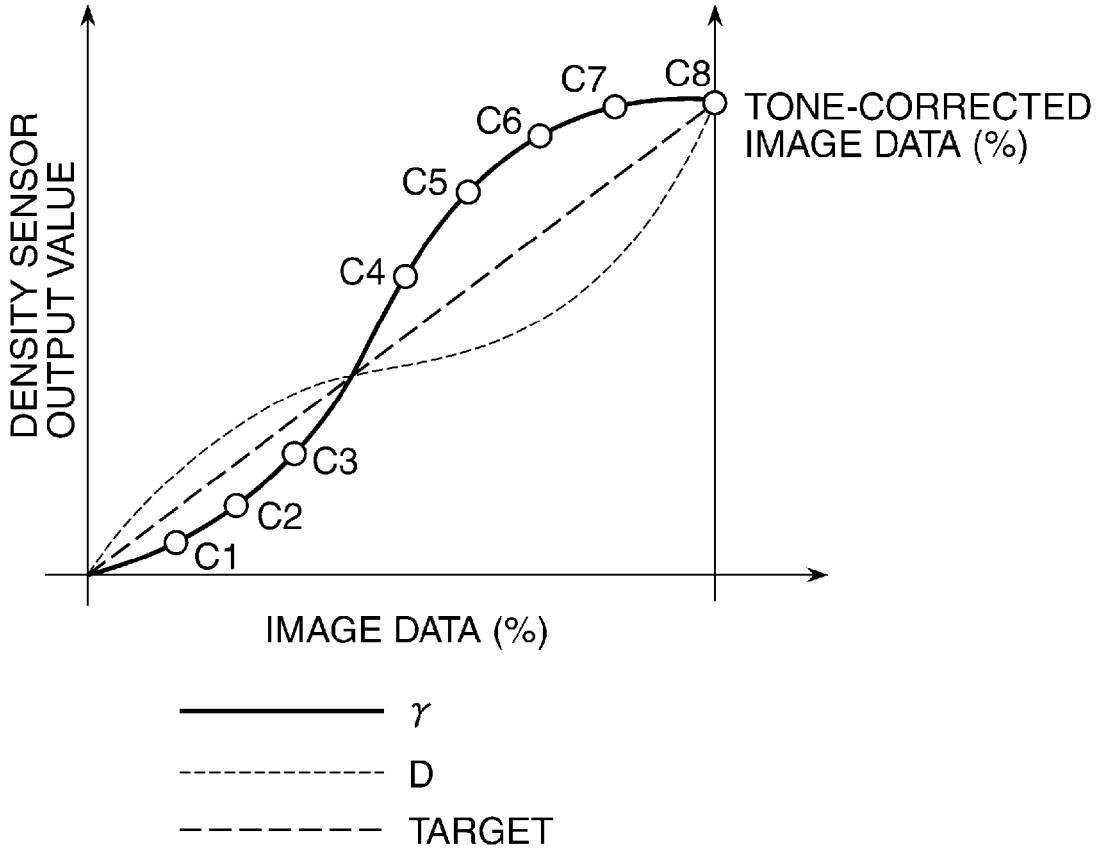
FIG. 10 is a diagram useful in explaining a method to update a one-dimensional lookup table.

Referring now to FIG. 10, a description will be given of how the one-dimensional lookup tables are updated. Here, a description will be given only of tone correction for the cyan color, but correction is performed in the same manner with respect to the magenta, yellow, and black colors as well. In the figure, the horizontal axis represents image data, and the vertical axis represents output value from the density sensor 41. Circular marks (C1, C2, C3, C4, C5, C6, C7, and C8) in the figure indicate density values for the respective toner patches transmitted from the toner patch density transmission unit 604 in the image control unit 3. Moreover, a straight line designated by TARGET in the figure represents target density tone characteristics in the image density control. In the present embodiment, the target density tone characteristics TARGET are determined so that image data and density have a proportional relationship. A curve designated by γ in the figure represents density tone characteristics in a state in which the image density control has not been performed yet. It should be noted that densities of tones where toner patches are not formed are calculated by carrying out spline interpolation so as to pass through an origin point as well as the points C1, C2, C3, C4, C5, C6, C7, and C8.

A curve designated by D in the figure represents a one-dimensional lookup table calculated in the present control, and calculated by obtaining symmetrical points of the tone characteristics γ with respect to the target tone characteristics TARGET. The calculated one-dimensional lookup table D replaces a previously calculated one-dimensional lookup table stored in the output gamma correction unit 1212, thus completing the update. Thereafter, when a print image is to be formed, target tone characteristics can be obtained by correcting image data using the one-dimensional lookup table obtained in this step.

In step S12, the CPU 10 determines whether or not the job has completed at the time when the image density control ends. When the job has completed, the present process is terminated, and the image forming unit 1 and the CPU 10 goes into a standby state. On the other hand, when the job has not completed, the CPU 10 resets, in step S14, a parameter C managed as a sheet counter according to (Equation 05) given below, and returns to step S2:

$$C=0; \quad \text{(Equation 05)}$$

As described above, as compared with the conventional image forming apparatus in terms of the time period required for control, the time period for rotation of the intermediate transfer unit required in advance before formation of toner patches, and measurement toner patch densities while continuing the rotation in the conventional image forming apparatus is:

(the image density control time period in the conventional image forming apparatus)

=base measurement (one circumference of the intermediate transfer unit)+toner patch measurement (one circumference of the intermediate transfer unit)

=895÷246+895÷246

=7.3 seconds

On the other hand, in the image forming apparatus according to the present embodiment, because it is unnecessary to rotate the intermediate transfer unit 27 in advance (because phases of the base directly below toner patches can be grasped by the density sensors 41 and 42), the above time period is as follows:

(the image density control time period in the image forming apparatus according to the present embodiment)

=toner patch measurement (one circumference of the intermediate transfer unit)

=895÷246

=3.6 seconds

Thus, the time period can be shortened by 7.3−3.6=3.7 seconds.

As described above, according to the present embodiment, the time period for rotation of the intermediate transfer unit required before formation of toner patches, and measurement toner patch densities while continuing the rotation can be shortened.

In a second embodiment of the present invention, by not only performing the image density control of the above described first embodiment but also considering fogging stains (fogging toner) appearing on surfaces of toner patches having passed through the photosensitive drums, degradation in toner density measurement accuracy due to fogging stains can be prevented.

An overall arrangement of a color image forming apparatus and arrangements of density sensors are the same as those of the color image forming apparatus according to the above described first embodiment, and description thereof is omitted using the same reference numerals for the same component elements.

In the above described first embodiment, the computation unit 603 refers to, from the base profile, a regular reflected light output Ri (base directly below toner patch) when a surface of the intermediate transfer unit 27 directly below a toner patch is read, and refers to, from the toner patch profile, a regular reflected light output Ri (toner patch) when the toner patch is read. Then, the computation unit 603 calculates a toner patch density DENSi (toner patch) according to (Equation 03). The toner patch density DENSi can be calculated with accuracy according to (Equation 03).

However, in electrophotographic image forming apparatuses, there may be a case where toner (fogging toner) developed at a charge potential position on an image carrier, which is a photosensitive drum, due to unevenness in the amount of electric charge which toner has is transferred to the intermediate transfer unit 27. When there is a toner patch on the intermediate transfer unit 27 at the time when the fogging toner is transferred, a new toner layer is formed on (added to) the toner patch. When a toner patch density is calculated by reading this toner patch, a density reading error occurs. Thus, in the present embodiment, the computation unit 603 performs a process described hereafter so as to prevent degradation in toner density measurement accuracy.

In a toner patch profile read by the density sensor 41, a regular reflected light output obtained by reading a place where no toner patch is formed, that is, a base itself are stored in first several steps. This is referred to as a first output that is output by reading a first surface of the intermediate transfer unit 27 to which a toner patch has not been transferred by the density sensor 41. On the other hand, an output in the toner patch profile which is output by reading a second surface of the intermediate transfer unit 27 to which a toner patch has not been transferred by the density sensor 41 is referred to as a second output.

Similarly, in a base profile read by the density sensor 42, a regular reflected light output obtained by reading a base in an area where a toner patch will not be formed is stored in first several steps. This is referred to as a third output that is output by reading a third surface of the intermediate transfer unit 27 to which a toner patch has not been transferred by the density sensor 42. On the other hand, an output in the toner patch profile which is output by reading a surface of the intermediate transfer unit 27 to which a toner patch has been transferred by the density sensor 42 is referred to as a fourth output.

Moreover, in the present embodiment, the toner patch profile and the base profile are in phase with each other on the intermediate transfer unit 27 as described above. In particular, the first output and the second output are outputs obtained in different phases on the intermediate transfer unit 27, and the first output and the third output are outputs obtained in the same phase on the intermediate transfer unit 27. The second output and the fourth output are outputs obtained in the same phase on the intermediate transfer unit 27.

In the present embodiment, assuming that the above-mentioned first several steps are 10 steps, the computation unit 603 calculates a difference ΔR in output between both profiles according to (Equation 06) given below. This is an exemplary toner calculation unit in the present embodiment.

$$\Delta R=\Sigma(\text{Ri(base profile)}-\text{Ri(toner patch profile)})\div 10 \quad \text{(Equation 06)}$$

A value obtained by (Equation 06) is equivalent to the amount of fogging toner of three MCK colors. When toner patch densities are to be actually calculated, correction is performed by weighting the value obtained by (Equation 06) with respect to each color as described below.

(YELLOW)

$$\text{DENSi(toner patch)}=(\text{Ri(toner patch)}+3\times\Delta R/4)\div\text{Ri (base directly below toner patch)} \quad \text{(Equation 07)}$$

(MAGENTA)

$$\text{DENSi(toner patch)}=(\text{Ri(toner patch)}+2\times\Delta R/4)\div\text{Ri (base directly below toner patch)} \quad \text{(Equation 08)}$$

(CYAN)

$$\text{DENSi(toner patch)}=(\text{Ri(toner patch)}+1\times\Delta R/4)\div\text{Ri (base directly below toner patch)} \quad \text{(Equation 09)}$$

(BLACK)

$$\text{DENSi(toner patch)}=(\text{Ri(toner patch)}+0\times\Delta R/4)\div\text{Ri (base directly below toner patch)} \quad \text{(Equation 10)}$$

By performing correction using the above (Equation 07) through (Equation 10), density reading errors corresponding to the amount of fogging toner can be cancelled with respect to toner patches of the respective colors.

The flow of the image density control in the second embodiment is the same as that of image density control according to the first embodiment described above, and therefore, description thereof is omitted.

According to the second embodiment, the effect of reducing the time period can be obtained as is the case with the first embodiment, and in addition, degradation in toner density measurement accuracy due to fogging stains (fogging toner) appearing on surfaces of toner patches having passed through the photosensitive drums can be prevented.

According to a third embodiment, fogging stains (fogging toner) appearing on surfaces of toner patches having passed through the photosensitive drums are calculated for each color, so that degradation in toner density measurement accuracy due to fogging stains can be prevented more reliably as compared to the above described second embodiment.

Figure 11:
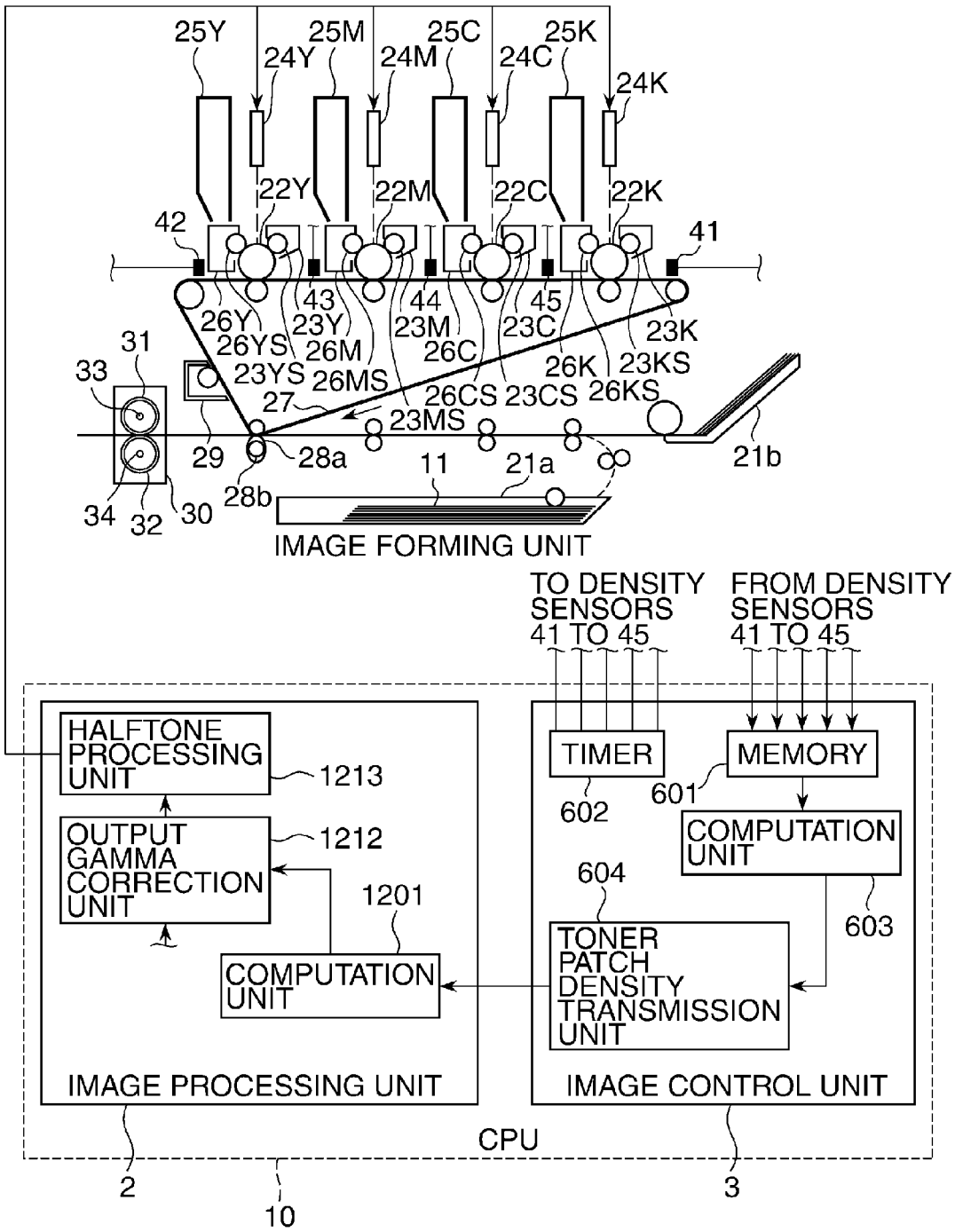
FIG. 11 is a diagram schematically showing an overall arrangement of an image forming apparatus according to a third embodiment of the present invention.

An overall arrangement of a color image forming apparatus and arrangements of density sensors according to the third embodiment are the same as those of the color image forming apparatus according to the above described first embodiment, and description thereof is omitted using the same reference numerals for the same component elements. The color image forming apparatus according to the third embodiment differs from the color image forming apparatus according to the above described first embodiment in that as shown in FIG. 11, density sensors 43, 44, and 45 are placed in the image forming unit 1 with the photosensitive drums of the respective CMYK colors interposed therebetween. The density sensors 41 to 45 are connected to the memory 601, and also connected to the timer 602.

The memory 601 in the image control unit 3 stores a base profile and a toner patch profile for each of the CMYK colors. For example, in the case of yellow, the memory 601 obtains a base profile for yellow from the density sensor 42, obtains a toner patch profile for yellow from the density sensor 43, and stores them. Similarly, a plurality of base profiles and a plurality of toner patch profiles are stored in the memory 601 for the magenta, cyan, and black colors.

The computation unit 603 in the image control unit 3 calculates toner patch densities, described above in the description of the second embodiment, for each color according to (Equation 06) using the base profiles and the toner patch profiles for the respective colors stored in the memory 601. As a result, the differences ΔR are calculated for the respective colors (here, ΔR_YELLOW, ΔR_MAGENTA, ΔR_CYAN, and ΔR_BLACK are calculated).

In the third embodiment, the computation unit 603 performs density correction for toner patches according to (Equation 07a) through (Equation 10a) obtained by making modifications to (Equation 07) through (Equation 10) using the differences ΔR as below.

(YELLOW)

$$\text{DENSi(toner patch)}=(\text{Ri(toner patch)}+\Delta R_\text{YELLOW})\div\text{Ri(base directly below toner patch)} \quad \text{(Equation 07a)}$$

(MAGENTA)

$$\text{DENSi(toner patch)}=(\text{Ri(toner patch)}+\Delta R_\text{MAGENTA})\div\text{Ri(base directly below toner patch)} \quad \text{(Equation 08a)}$$

(CYAN)

$$\text{DENSi(toner patch)}=(\text{Ri(toner patch)}+\Delta R_\text{CYAN})\div\text{Ri (base directly below toner patch)} \quad \text{(Equation 09a)}$$

(BLACK)

$$\text{DENSi(toner patch)}=(\text{Ri(toner patch)}+\Delta R_\text{BLACK})\div\text{Ri(base directly below toner patch)} \quad \text{(Equation 10a)}$$

By performing correction using the above (Equation 07a) through (Equation 10a), density reading errors corresponding to the amount of fogging toner can be cancelled with respect to toner patches of the respective colors.

The flow of image density control is the same as that of image density control according to the first embodiment described above, and therefore, description thereof is omitted.

According to the third embodiment, because fogging stains (fogging toner) appearing on surfaces of toner patches having passed through the photosensitive drums of the respective colors are calculated for each color, degradation in toner density measurement accuracy due to fogging stains can be prevented more reliably as compared to the second embodiment.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-018850 filed Jan. 29, 2010, which is hereby incorporated by reference herein in its entirety.

What is claimed is:

1. An image forming apparatus comprising:

an image carrier configured to have a toner image formed thereon while rotating;

a transfer member configured to be conveyed in a conveying direction while being in contact with said rotating image carrier;

a transfer unit configured to transfer the toner image formed on said image carrier to a surface of said transfer member;

a correction unit configured to form a toner image for detection on said image carrier, and correct image forming conditions based on an amount of toner obtained by reading the toner image for detection transferred to said transfer member by said transfer unit;

a first reading unit configured to be disposed upstream of said transfer unit in the conveying direction of said transfer member, and read the surface of said transfer member being conveyed in the conveying direction;

a second reading unit configured to be disposed downstream of said transfer unit in the conveying direction of said transfer member, and read the surface of said transfer member being conveyed in the conveying direction;

a storage unit configured to store outputs from said first reading unit as a first profile, and store outputs from said second reading unit as a second profile; and a toner density calculation unit configured to calculate a toner density of the toner image for detection based on the first profile and the second profile stored in said storage unit, wherein said correction unit corrects image forming conditions based on the toner density calculated by said toner density calculation unit.

2. An image forming apparatus according to claim 1, wherein:

the first profile is output by said first reading unit reading said transfer member to which the toner image for detection has not been transferred, the second profile is output by said second reading unit reading said transfer member to which the toner image for detection has been transferred, and the first profile and the second profile are in phase with each other on said transfer member.

3. An image forming apparatus according to claim 1, further comprising:

a fogging toner amount calculation unit configured to calculate an amount of fogging toner to be transferred onto said transfer member having passed through said transfer unit based on a difference between a first output that is output by reading said first reading unit reading a first surface of said transfer member to which the toner image for detection has not been transferred, and a third output that is output by reading said second reading unit reading a third surface of said transfer member to which the toner image for detection has not been transferred, wherein said toner density calculation unit calculates the toner density based on a second output that is output by reading said first reading unit reading a second surface of said transfer member to which the toner image for detection has not been transferred, and a fourth output that is output by reading said second reading unit reading a surface of said transfer member to which the toner image for detection has been transferred, and wherein said correction unit corrects the calculated toner density using the amount of fogging toner, and corrects image forming conditions according to the corrected toner density.

4. An image forming apparatus according to claim 3, wherein the first output and the second output are outputs obtained in different phases on said transfer member, the first output and the third output are outputs obtained in the same phase on said transfer member, and the second output and the fourth output are outputs obtained in the same phase on said transfer member.

5. An image forming apparatus comprising:

a plurality of image carriers each configured to have a toner image formed thereon while rotating;

a transfer member configured to be conveyed in a conveying direction while being in contact with said plurality of rotating image carriers;

a plurality of transfer units configured to transfer the toner images formed on said plurality of image carriers in a superposed manner on a surface of said transfer member;

a correction unit configured to form toner images for detection on said image carriers, and correct image forming conditions based on an amount of toner by reading the toner images for detection transferred to said transfer member by said plurality of transfer units;

a first reading unit configured to be disposed upstream of said plurality of transfer units in the conveying direction of said transfer member, and read the surface of said transfer member being conveyed in the conveying direction;

a plurality of second reading units configured to be disposed downstream of respective ones of said plurality of transfer units in the conveying direction of said transfer member, and read the surface of said transfer member being conveyed in the conveying direction;

a storage unit configured to store outputs from said first reading unit as a first profile, and store outputs from said plurality of second reading units as a second profile; and a toner density calculation unit configured to calculate toner densities of the toner images for detection based on the first profile and the second profile stored in said storage unit, wherein said correction unit corrects image forming conditions based on the toner densities calculated by said toner density calculation unit.

6. An image forming apparatus according to claim 5, wherein said toner density calculation unit calculates the toner density of the toner image for detection on a color-by-color basis using the first profile and the second profile for each color stored in said storage unit.

* * * * *